US008622065B2

(12) United States Patent
Shin et al.

(10) Patent No.: US 8,622,065 B2
(45) Date of Patent: Jan. 7, 2014

(54) DISH WASHER

(75) Inventors: Gap Su Shin, Cheongju-si (KR); Soon Yong Kwon, Busan (KR)

(73) Assignee: LG Electronics Inc., Seoul (KR)

( * ) Notice: Subject to any disclaimer, the term of this patent is extended or adjusted under 35 U.S.C. 154(b) by 737 days.

(21) Appl. No.: 12/096,466

(22) PCT Filed: Dec. 6, 2006

(86) PCT No.: PCT/KR2006/005226

§ 371 (c)(1),
(2), (4) Date: Nov. 17, 2008

(87) PCT Pub. No.: WO2007/066968

PCT Pub. Date: Jun. 14, 2007

(65) Prior Publication Data

US 2009/0133724 A1 May 28, 2009

(30) Foreign Application Priority Data

Dec. 9, 2005 (KR) ..... 10-2005-0120627
Sep. 20, 2006 (KR) ..... 10-2006-0091154

(51) Int. Cl.
*B08B 3/04* (2006.01)

(52) U.S. Cl.
USPC ..... 134/104.4; 134/56 D; 134/57 D; 134/58 D

(58) Field of Classification Search
USPC ..... 134/104.4, 56 D, 57 D, 58 D
See application file for complete search history.

(56) References Cited

U.S. PATENT DOCUMENTS

| | | | | |
|---|---|---|---|---|
| 5,165,433 | A | 11/1992 | Meyers | 134/104.4 |
| 5,601,660 | A | 2/1997 | Jeon et al. | |
| 2004/0163690 | A1 * | 8/2004 | Kim | 134/104.1 |
| 2005/0022849 | A1 * | 2/2005 | Park et al. | 134/58 D |
| 2005/0133072 | A1 * | 6/2005 | Yoon et al. | 134/58 D |
| 2005/0263174 | A1 * | 12/2005 | Yoon et al. | 134/104.1 |

FOREIGN PATENT DOCUMENTS

| | | | |
|---|---|---|---|
| CN | 1145772 | A | 3/1997 |
| EP | 0990413 | | 12/2003 |
| EP | 0842632 | | 2/2006 |
| KR | 20-1988-0005951 | U | 5/1988 |
| KR | 20-1992-0011206 | U | 7/1992 |
| KR | 10-1997-0005223 | | 6/1997 |
| KR | 10-1997-0010418 | | 6/1997 |
| KR | 20-1998-0022732 | U | 7/1998 |

(Continued)

OTHER PUBLICATIONS

Korean Decision to Grant a Patent dated Nov. 24, 2007 for Application No. 10-2006-0091154.

(Continued)

*Primary Examiner* — Michael Barr
*Assistant Examiner* — Benjamin L Osterhout
(74) *Attorney, Agent, or Firm* — KED & Associates, LLP

(57) ABSTRACT

A dish washer is disclosed. The dish washer has improved washing efficiency while being constructed in a compact structure. A general dish washer is an apparatus that injects wash water to dishes so as to wash the dishes, and dries and/or sterilizes the washed dishes. The washer according to the present invention includes a filter unit (170) filtering at least some of the wash water injected form a tub (1), fallen downward, and directed to a collection part of sump (20).

19 Claims, 12 Drawing Sheets

(56) References Cited

FOREIGN PATENT DOCUMENTS

| | | | |
|---|---|---|---|
| KR | 10-1998-0083127 | A | 12/1998 |
| KR | 10-1999-0016951 | A | 3/1999 |
| KR | 2000-0002678 | | 1/2000 |
| KR | 10-2005-0062145 | | 6/2005 |
| KR | 10-2005-0112723 | | 12/2005 |

OTHER PUBLICATIONS

Chinese Office Action dated Mar. 24, 2010 for Application No. 2006800426284.1.

* cited by examiner

DISH WASHER

TECHNICAL FIELD

The present invention relates to a dish washer, and more particularly, to a dish washer having improved washing efficiency while being constructed in a compact structure. A general dish washer is an apparatus that injects wash water to dishes so as to wash the dishes, and dries and/or sterilizes the washed dishes.

BACKGROUND ART

FIG. 1 is a view schematically illustrating the whole construction of a conventional dish washer, FIG. 2 is an exploded perspective view fully illustrating a drive unit of the dish washer shown in FIG. 1, FIG. 3 is a top view illustrating a flow channel structure of a filter housing shown in FIG. 2, and FIG. 4 is a sectional view illustrating the flow of wash water in the drive unit shown in FIG. 2 during a washing operation.

FIG. 5 is a top view illustrating the flow of wash water in the filter housing shown in FIG. 2 during a washing operation, and FIG. 6 is a top view illustrating the flow of wash water in the filter housing shown in FIG. 2 during a draining operation.

First, the schematic structure of a conventional dish washer will be described with reference to FIG. 1.

The conventional dish washer is constructed in a structure in which upper and lower washing arms 4 and 5, upper and lower racks 6 and 7, and a drive unit 10 are mounted in tub 1.

To the drive unit 10 are connected upper and lower connection pipes 2 and 3, through which wash water is supplied to the upper and lower washing arms 4 and 5, respectively, and a drainage hose 9, through which the wash water is drained. The upper and lower washing arms 4 and 5 are connected to the upper and lower connection pipes 2 and 3, respectively. The upper rack 6 is mounted above the upper washing arm 4, and the lower rack 7 is mounted above the lower washing arm 5.

The upper and lower washing arms 4 and 5 are rotatably mounted above the drive unit 10. The respective washing arms 4 and 5 are provided with injection holes, through which wash water is injected toward the corresponding racks. In addition, the lower washing arm 5 is provided with injection holes, through which wash water is injected toward the drive unit 10 such that food wastes are removed from a filter of the drive unit 10 by the injected wash water.

Next, the structure of the drive unit of the dish washer will be described in detail with reference to FIG. 2.

The drive unit 10 includes a sump 20 for receiving wash water, a heater 30 mounted at the sump 20 for heating the wash water, a washing pump 41 and 42 mounted at the sump 20 for pumping the wash water, a drainage pump 51 and 52 mounted at the sump 20 for draining the wash water, and a filtering unit for guiding some of the pumped wash water to the washing arms 4 and 5 (see FIG. 1) and filtering the remainder of the pumped wash water.

The sump 20 has a wash water receiving part 21, which is a space for receiving the wash water, and a drainage chamber 22 partitioned from the wash water receiving part 21. To the outside of the wash water receiving part 21 is mounted a flow channel control unit 25. A flow channel control valve 26 is axially coupled to the flow channel control unit 25.

The washing pump includes a washing motor 41 mounted to the bottom of the sump for generating a driving force, and an impeller 42 mounted in the filtering unit for pumping the wash water. To a shaft of the washing pump 41 is axially coupled a disposer 45 that is rotatable to crush food wastes.

Above the disposer 45 is disposed a screen 46 having a predetermined mesh for filtering out large particles of food wastes.

The drainage pump is mounted at the drainage chamber 22. The drainage pump includes a drainage motor 51 and an impeller 52.

The filtering unit includes a pump housing 60 having a space where the impeller 42 is mounted, a filter housing 70 mounted such that the filter housing 70 covers the top of the pump housing 60, and a cover 80 mounted such that the cover 80 covers the top of the filter housing 70 and the top of the sump 20. The pump housing 60 is disposed at the bottom of the filter housing 70, and the cover 80 is disposed at the top of the filter housing 70.

The filter housing 70 has a filth collection chamber 75. The filth collection chamber 75 has a drainage pipe 75*a*, which communicates with the drainage chamber 22. The drainage pipe 75*a* protrudes downward by a predetermined length from the bottom of the filter housing 70. Consequently, the drainage pipe 75*a* is located in the drainage chamber 22 at the time of assembling the drive unit.

The cover 80 has a filter 81, which is disposed corresponding to the filth collection chamber 75 of the filter housing 70, and a plurality of collection holes 82 formed outside the filter 81. The collection holes 82 communicate with the sump 20.

Hereinafter, the filter housing 70, in which the flow channel control valve 26 is mounted, will be described in more detail with FIGS. 2 and 3, particularly FIG. 3.

The filter housing 70 includes a wash water introduction part 72 constructed such that wash water pumped by the impeller is introduced to the wash water introduction part 72, and main flow channels 73*a* and 73*b* and a sampling flow channel 74 connected to the wash water introduction part 72. The filth collection chamber 75 is connected to the sampling flow channel 74. At the drainage pipe 75*a* of the filth collection chamber 75 is mounted an opening and closing valve for discharging the wash water and the food wastes from the filth collection chamber 75 to the drainage chamber 22 (see FIG. 2) at the time of a draining operation.

In the above description, the sampling flow channel 74 is a flow channel formed to continuously filter out foreign matter contained in the wash water collected in the sump 20 using some of the wash water introduced to the wash water introduction part 72.

The flow channel control valve 26 is rotatably located in the wash water introduction part 72 of the filter housing 70 for opening and closing the main flow channels 73*a* and 73*b*. The flow channel control valve 26 is axially coupled to the flow channel control unit 25 (see FIG. 2) mounted at the sump 20. At the edge of the flow channel control valve 26 is formed an opening and closing rib 26*a* for opening and closing the main flow channels 73*a* and 73*b*.

Now, the operation of the dish washer with the above-stated construction will be described.

The dish washer performs sequentially or selectively a preliminary washing operation, a main washing operation, a rinsing operation, a heating-rinsing operation, and a drying operation so as to wash dishes. Between the respective operations, a draining operation is performed. Hereinafter, the main washing operation and the draining operation will be described.

When the main washing operation is initiated, the washing motor is driven, and therefore, the impeller 42 is rotated. As a result, as shown in FIG. 4, the impeller 42 pumps wash water (containing detergent) from the sump 20 to the wash water introduction part 72 (see FIG. 3) of the pump housing 60.

At this time, the flow channel control unit 25 is rotated. As a result, the flow channel control valve 26 selectively opens one of the main flow channels 73*a* and 73*b* under the control of a microprocessor. For example, as shown in FIG. 5, the flow channel control valve 26 opens the main flow channel 73*a*. Although not shown, however, the flow channel control valve 26 may simultaneously open both the main flow channels 73*a* and 73*b*. That is, the opened state of the main flow channels is changed depending upon the rotating positions of the flow channel control valve 26.

Consequently, most of the wash water introduced into the wash water introduction part 72 is supplied to both the upper and lower washing arms 4 and 5 or one of the upper and lower washing arms 4 and 5 through the opened one(s) of the main flow channels 73*a* and 73*b* under the control of the flow channel control unit 25 based on the microprocessor. On the other hand, the remainder of the wash water is supplied to the filth collection chamber 75 through the sampling flow channel 74.

The flow channel control valve 26 may be controlled such that the two main flow channels 73*a* and 73*b* are simultaneously opened, and therefore, the wash water is supplied to both the upper and lower washing arms 4 and 5, such that only one of the main flow channels 73*a* and 73*b* is opened, and therefore, the wash water is supplied to one of the upper and lower washing arms 4 and 5, or such that the two main flow channels 73*a* and 73*b* are alternately opened, and therefore, the wash water is alternately supplied to the upper and lower washing arms 4 and 5.

On the other hand, some of the wash water is always supplied to the sampling flow channel 74 irrespective of which main flow channel is opened by the flow channel control valve 26. This is because the wash water must be continuously supplied to the sampling flow channel 74 in order to continuously filter out foreign matter from the wash water.

The wash water supplied to the filth collection chamber 75 through the sampling flow channel 74 overflows through the filter 81 disposed above the filth collection chamber 75. At this time, the filter 81 filters out foreign matter from the wash water.

The wash water filtered during the overflow and the wash water injected through the upper and lower washing arms 4 and 5 and having fallen to the cover 80 is reintroduced into the sump 20 through the collection holes 82.

When the wash water flows through the sampling flow channel 74 for a short period of time, the amount of wash water flowing through the sampling flow channel 74 is small, and therefore, the filtering effect of the wash water accomplished through the sampling flow channel is insignificant. According to the present invention, however, the wash water continuously flows through the sampling flow channel 74 for a relatively long period of time during the main washing operation, and therefore, most of the wash water is substantially filtered.

After the washing operation is completed, a draining operation is initiated.

When the draining operation is initiated, the drainage pump 51 and 52 is driven. At this time, wash water and food wastes in the sump 20 are introduced to the drainage pump 51 and 52 due to a suction force of the drainage pump 51 and 52. At the same time, as shown in FIG. 6, wash water and food wastes in the filth collection chamber 75 are also introduced to the drainage pump 51 and 52 through the drainage pipe 75*a*. The wash water and the food wastes introduced to the drainage pump 51 and 52 are discharged to the outside through the drainage hose 9 (see FIG. 1).

However, the conventional dish washer has the following problems.

First, the dish washer has a problem in that only some of the pumped wash water is injected through the washing arms, and therefore, the amount of wash water substantially injected to wash dishes is considerably reduced, whereby the washing efficiency of the dish washer is lowered. Also, the wash water is pumped in consideration of the amount of wash water circulating through the sampling flow channel, and therefore, it is needed to increase the capacity of the washing pump such that the amount of the injected wash water is sufficiently maintained.

Second, it is needed to consider the amount of wash water to be sufficiently injected to the dishes through the washing arms, the amount of wash water filtered while circulating through the sampling flow channel, and the amount of wash water injected from the lower washing arm to the filter so as to remove the food wastes from the filter. As a result, the amount of wash water substantially needed during the washing operation of the dish washer is considerably increased.

Third, the wash water pumped from the sump is directly introduced into the filth collection chamber through the sampling flow channel. As a result, a large amount of filth is introduced into the filth collection chamber, and therefore, the filter of the cover is clogged. Also, when the filter is clogged, large water pressure is applied to the filth collection chamber with the result that the wash water in the filth collection chamber is drained through the drainage hose, and therefore, the wash water is wasted. Furthermore, fatigue is accumulated in the filter, and therefore, the filter may be deformed.

Fourth, when the wash water is wasted as described above, it is needed to replenish wash water. Also, when a heating-washing operation is performed, the replenished wash water must be heated by the heater. Consequently, the consumption of wash water and power is unnecessarily increased.

Fifth, the sampling flow channel and the filth collection chamber are separately formed to filter the wash water. Consequently, the flow channel of the wash water is complicated. In addition, as the flow channel is complicated, wash water pumping pressure is considerably decreased. As a result, it is needed to use a washing pump having an increased capacity.

Sixth, the washing pump is mounted in an upright driven fashion, the disposer is mounted to the shaft of the washing pump, and the filth collection chamber is mounted above the pump housing. As a result, the structure of the drive unit is complicated, and the height of the drive unit is greatly increased. Otherwise, it is needed to reduce the inner space of the sump. Furthermore, as the size of the drive unit is increased, the capacity of the tub is relatively decreased.

Seventh, the flow channel of the dish washer is complicated, and food wastes are left in the filth collection chamber and the filter during the drainage operation of the dish washer. As time passes, the leftover food wastes go rotten in the dish washer, thereby generating a bad smell. Furthermore, when the food wastes are left in various flow channels, such as the filth collection chamber, it is very difficult to remove the food wastes.

DISCLOSURE OF INVENTION

Technical Problem

An object of the present invention devised to solve the problem lies on a dish washer that is capable of injecting all pumped wash water to dishes through washing arms, thereby improving the washing efficiency of the dish washer, allowing a washing pump having a small capacity to be applied to the dish washer, and considerably decreasing the amount of wash water substantially needed during a washing operation of the dish washer.

Another object of the present invention devised to solve the problem lies on a dish washer that is capable of preventing wash water from being unnecessarily drained, thereby reducing the consumption of wash water and power.

Another object of the present invention devised to solve the problem lies on a dish washer wherein a sampling flow channel and a filth collection chamber used to filter wash water are omitted to simplify a wash water flow channel, whereby the flow channel resistance is reduced, wash water pumping pressure is considerably increased, and a washing pump having a smaller capacity is applied to the dish washer.

Another object of the present invention devised to solve the problem lies on a dish washer wherein a disposer and a screen are omitted to simplify the structure of a drive unit, whereby the height of the drive unit is considerably decreased, the inner space of a sump is increased, and, as the size of the drive unit is decreased, the capacity of a tub is relatively increased.

A further object of the present invention devised to solve the problem lies on a dish washer that is capable of minimally preventing food wastes from being left in the sump during a drainage operation of the dish washer and easily cleaning the filtered-out food wastes.

Technical Solution

The object of the present invention can be achieved by providing a dish washer including a sump for receiving wash water, an impeller for generating a pumping force to pump the wash water in the sump, a washing motor, disposed in an upright driven structure in which a shaft of the washing motor is disposed approximately vertically, for providing a rotating force to the impeller, a housing assembly having flow channels for guiding the pumped wash water to washing arms, a cover disposed to cover the upper end of the sump, and a filter unit disposed in the sump through the cover for filtering the wash water having fallen to the cover and supplying the filtered wash water into the sump.

The sump has a collection part for collecting and storing wash water.

Preferably, the washing motor is an outer-rotor type brushless direct current (BLDC) motor.

Preferably, the sump is provided with a filth receiving chamber for receiving filth filtered out by the filter unit, the filth receiving chamber communicating with a drainage pump.

The filth receiving chamber is disposed at the bottom of the sump. Preferably, the filth receiving chamber has a bottom lower than a bottom of the collecting part.

Preferably, the filth receiving chamber is inclined toward the drainage pump side.

Preferably, the filter unit has an open lower end, and the open lower end of the filter unit is coupled to the filth receiving chamber.

The lower end of the filter unit may be spaced a predetermined distance from the bottom of the filth receiving chamber.

Also, a discharge flow channel is formed such that the filth receiving chamber and the drainage pump communicate with each other.

A drainage chamber is formed in the sump such that the drainage pump is mounted to the drainage chamber. The drainage chamber and the filth receiving chamber communicate with each other through the discharge flow channel.

The filter unit includes an upper filter fitted through the cover for filtering out large particles of filth from the wash water having fallen to the cover and a lower filter coupled to the upper filter and the filth receiving chamber for filtering out small particles of filth from the wash water having passed through the upper filter, the lower filter having an open lower end.

Preferably, the upper and/or lower filter is detachably attached to the cover such that a user can draw out the filter and remove filth from the filter.

Preferably, the upper filter protrudes a predetermined height from the top of the cover.

Preferably, the cover is inclined toward the filter unit side.

Preferably, a plurality of filter holes are formed in the cover such that some of the wash water having fallen to the cover is filtered and directly introduced into the sump, and the filter holes are disposed in the cover at regions where the housing assembly is not located.

The housing includes a pump compartment in which the impeller connected to the washing motor is disposed, a flow channel control compartment, communicating with the pump compartment, in which a flow channel control valve is disposed, and main flow channels for guiding the wash water from the flow channel control compartment to the respective washing arms.

Preferably, the pump compartment and the flow channel control compartment are disposed on the same plane.

The main flow channels are disposed above the pump compartment and the flow channel control compartment.

The housing assembly includes a lower housing having the pump compartment and the flow channel control compartment, an upper housing coupled to the lower housing such that the top of the lower housing is covered by the upper housing, the upper housing having the main flow channels, and a connection housing coupled to the upper housing such that the top of the upper housing is covered by the connection housing, the connection housing being also coupled to a connection pipe connected to the washing arms.

Preferably, the flow channel control valve includes a rotary shaft coupled to a shaft of a motor and a flow channel opening and closing plate connected to an upper end of the rotary shaft, formed generally in the shape of a disc, and having communication holes for selectively or simultaneously opening and closing the main flow channels when the flow channel opening and closing plate is rotated, the communication holes having different areas and formed at predetermined positions while the communication holes are spaced apart from each other.

According to the present invention, the flow channel control valve includes the flow channel opening and closing plate formed in the shape of a disc unlike the conventional dish washer as shown in FIG. 2. Consequently, load applied to the motor for rotating the flow channel opening and closing plate is greatly reduced, and the control speed is high.

According to the present invention, it is possible to improve the washing efficiency of the dish washer, reduce the capacity of the washing pump, considerably decrease the amount of wash water substantially needed during a washing operation of the dish washer, reduce the consumption of wash water and power, reduce the flow channel resistance, considerably increase the wash water pumping pressure, simplify the structure of the drive unit, considerably reduce the height of the drive unit, increasing the inner space of the sump, and minimally prevent food wastes from being left in the sump during a drainage operation of the dish washer.

Advantageous Effects

The dishwasher with the above-stated construction according to the present invention has the following effects.

First, the present invention has the effect of injecting all pumped wash water to dishes through washing arms, thereby improving the washing efficiency of the dish washer, reducing the capacity of a washing pump, and considerably decreasing the amount of wash water substantially needed during a washing operation of the dish washer.

Second, the present invention has the effect of preventing wash water from being unnecessarily drained, thereby reducing the consumption of wash water and power.

Third, the present invention has the effect of simplifying a wash water flow channel by omitting a sampling flow channel and a filth collection chamber used to filter wash water, thereby reducing the flow channel resistance, considerably increasing wash water pumping pressure, and allowing a washing pump having a smaller capacity to be applied to the dish washer.

Fourth, the present invention has the effect of simplifying the structure of a drive unit by omitting a disposer and a screen, thereby considerably decreasing the height of the drive unit, increasing the inner space of a sump, and relatively increasing the capacity of a tub as the size of the drive unit is decreased.

Fifth, the present invention has the effect of minimally preventing food wastes from being left in the sump during a drainage operation of the dish washer and easily cleaning the filtered-out food wastes.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Figure 1:
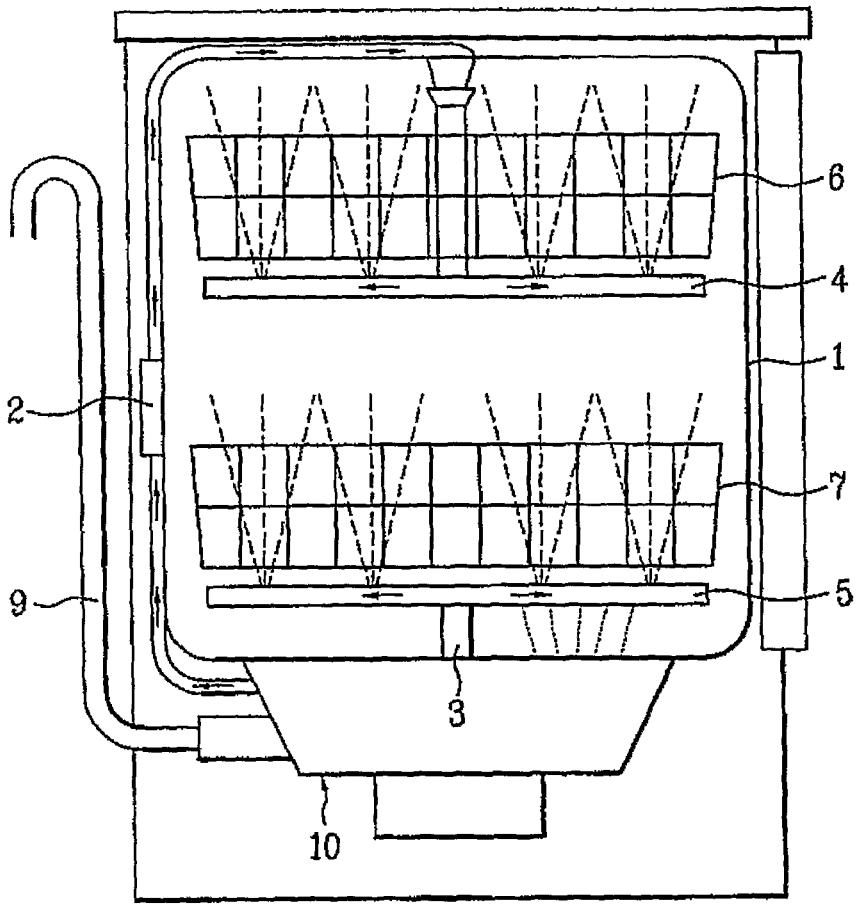
FIG. 1 is a view schematically illustrating the whole construction of a conventional dish washer.
Figure 2:
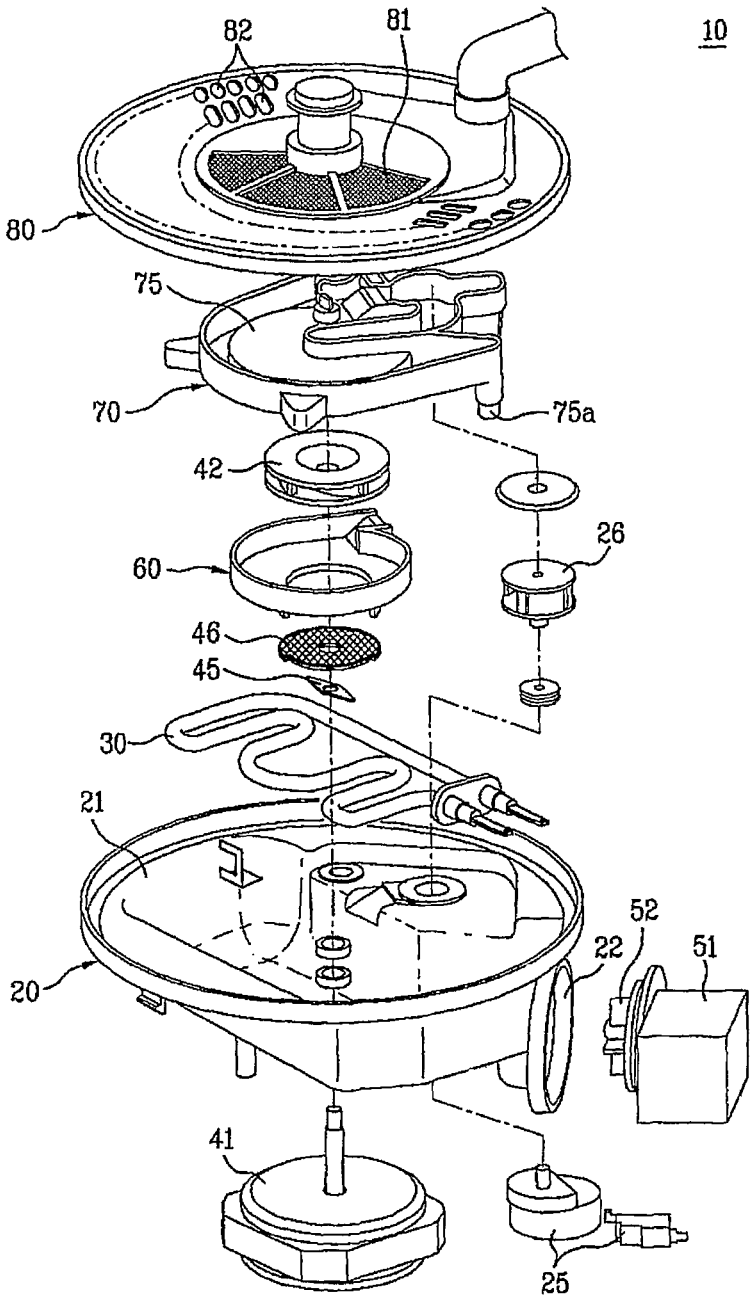
FIG. 2 is an exploded perspective view fully illustrating a drive unit of the dish washer shown in FIG. 1.
Figure 3:
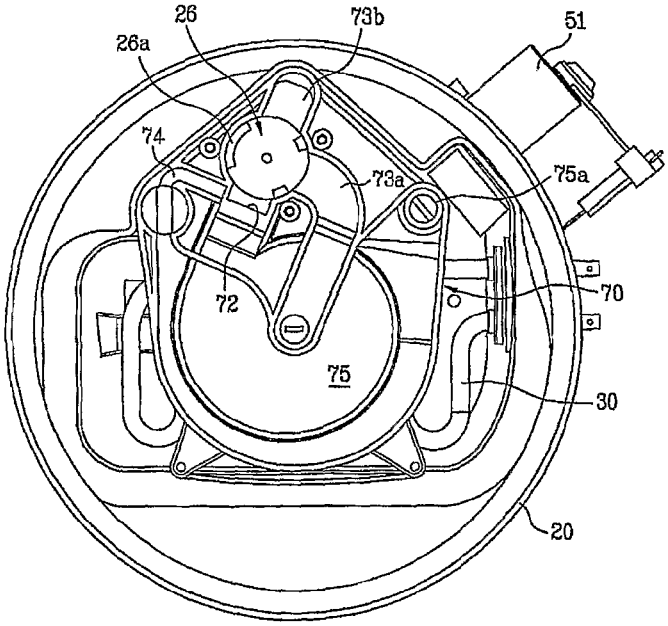
FIG. 3 is a top view illustrating a flow channel structure of a filter housing shown in FIG. 2.
Figure 4:
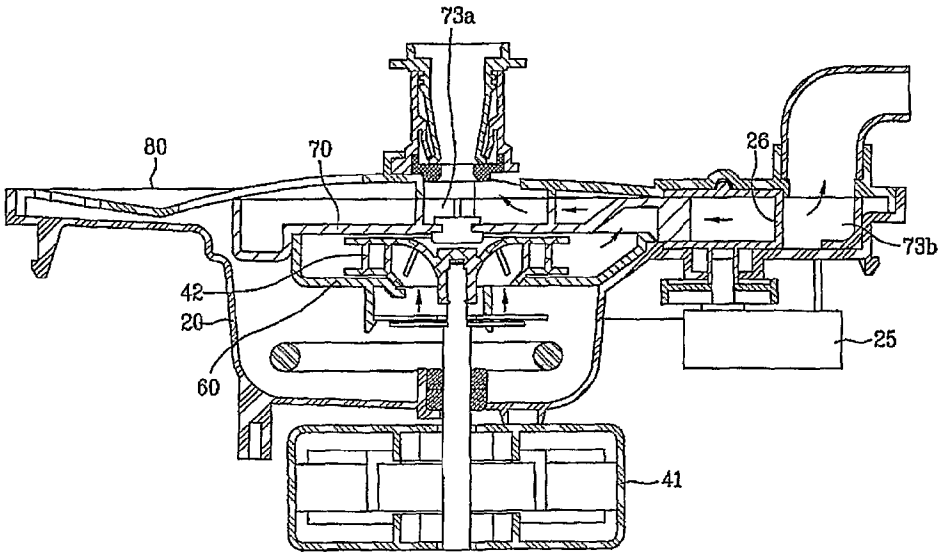
FIG. 4 is a sectional view illustrating the flow of wash water in the drive unit shown in FIG. 2 during a washing operation.
Figure 5:
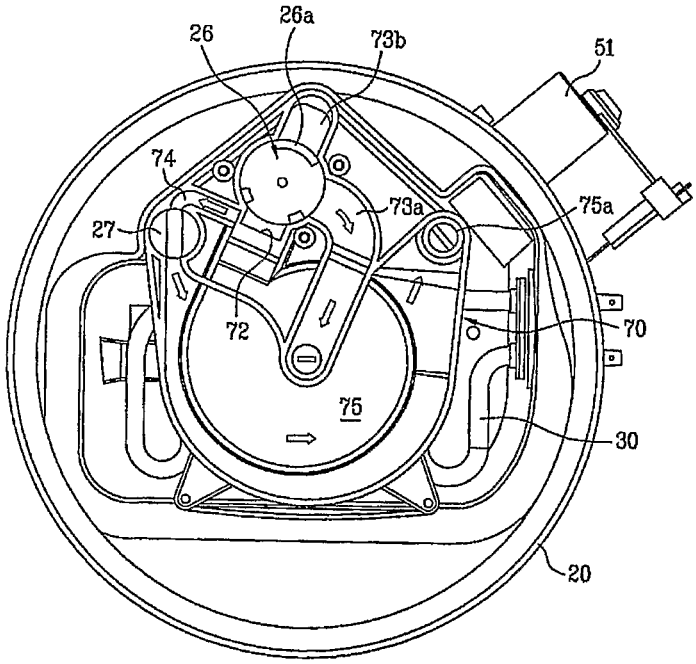
FIG. 5 is a top view illustrating the flow of wash water in the filter housing shown in FIG. 2 during a washing operation.
Figure 6:
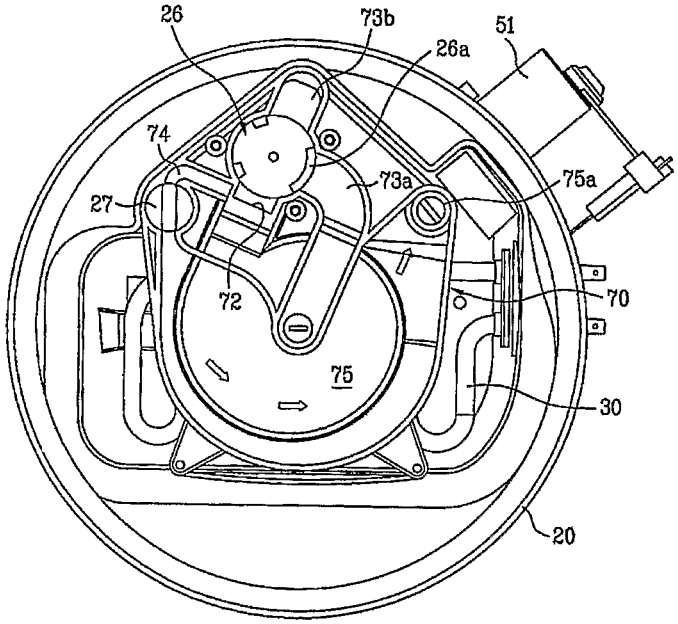
FIG. 6 is a top view illustrating the flow of wash water in the filter housing shown in FIG. 2 during a draining operation.

Reference will now be made in detail to the preferred embodiments of the present invention, examples of which are illustrated in the accompanying drawings.

A dish washer according to the present invention includes a sump 110 for receiving wash water, a washing pump 120 for pumping the wash water from the sump 110, a housing assembly 100 having flow channels 141 and 142 for guiding the pumped wash water to washing arms, a cover 160 disposed to cover the upper end of the sump 110, a filter unit 170 disposed in the sump 110 through the cover 160 for filtering wash water having fallen to the cover 160 and introducing the filtered wash water into the sump 110, and a drainage pump 180 communicating with the filter unit 170 for discharging filth filtered out by the filter unit and the wash water in the sump 110 to the outside at the time of a draining operation of the dish washer.

Preferably, a heater for heating the wash water is mounted in the sump 110. The heater is not illustrated in FIG. 7. Of course, the heater may be mounted at the bottom of a tub.

The sump 110 has a filth receiving chamber 111 for receiving filth filtered out by the filter unit 170. The filth receiving chamber 111 communicates with the drainage pump 180. Preferably, the filth receiving chamber 111 is mounted at the bottom of the sump 110. More preferably, the filth receiving chamber 111 is disposed with an inclination toward the drainage pump 180 such that the filth received in the filth receiving chamber 111 can be easily discharged to the drainage pump 180.

A discharge flow channel 112 is formed such that the filth receiving chamber 111 and the drainage pump 180 communicate with each other. Preferably, the filth receiving chamber 111 and a drainage chamber 113 communicate with each other through the discharge flow channel 112.

The drainage chamber 113 is formed in the sump 110 such that the drainage pump 180 is mounted to the drainage chamber 113. The drainage chamber 113 has a space where an impeller is disposed and a space into which filth is suctioned.

The washing pump 120 includes a washing motor 121 for generating a driving force and an impeller 122 axially coupled to the washing motor 121. The washing motor 121 is disposed in an upright driven structure in which a shaft of the washing motor 121 is disposed approximately vertically. Preferably, the washing motor 121 is an outer-rotor type brushless direct current (BLDC) motor.

The drainage pump 180 includes a drainage motor (not shown) and an impeller (not shown). The drainage pump 180 is disposed in a horizontally driven structure in which a shaft of the drainage motor is disposed approximately horizontally.

The housing assembly 100 includes a lower housing 130, an upper housing 140 coupled to the lower housing 130 such that the lower housing 130 is covered by the upper housing 140, and a connection housing 150 coupled to the upper housing 140 and a connection pipe connected to the washing arms.

The coupling of the upper and lower housings 140 and 130 provides a pump compartment 131 in which the impeller 122 constituting the washing pump 120 is disposed, and a flow channel control compartment 132, communicating with the pump compartment 131, in which a flow channel control valve is disposed.

The upper housing 140 has main flow channels 141 and 142 for guiding the wash water to the respective washing arms.

The connection housing 150 is coupled to the upper housing 140 such that the main flow channels 141 and 142 of the upper housing 140 are covered by the connection housing 150. The connection housing 150 is provided at the opposite ends thereof with coupling parts, which are coupled to connection pipes (not shown) connected to the washing arms.

Figure 7:
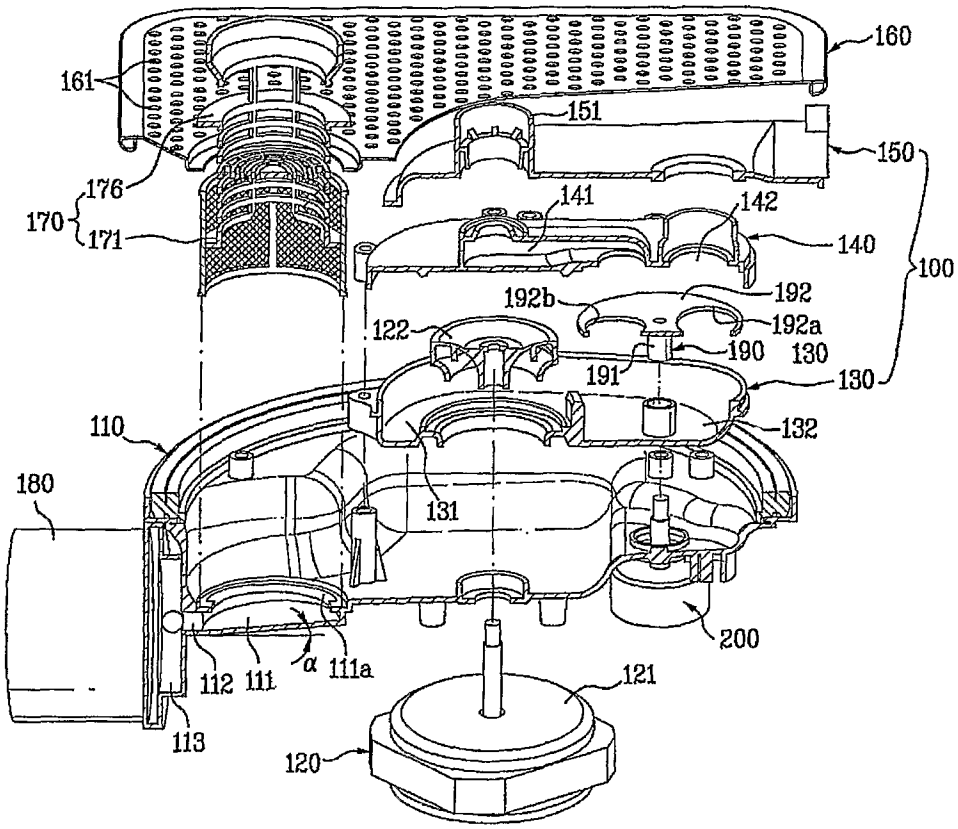
FIG. 7 is an exploded perspective view illustrating the construction of a dish washer according to the present invention.

The lower housing 130 and the upper housing 140 are separately constructed as shown in FIG. 7. Although not shown, however, the lower housing 130 and the upper housing 140 may be integrally constructed.

Preferably, the pump compartment 131 and the flow channel control compartment 132 are disposed on the same plane. This is because the height of the housing assembly 100 is decreased and the inner space of the sump 110 is increased. Also preferably, the main flow channels 141 and 142 are disposed above the pump compartment 131 and the flow channel control compartment 132. This is because the width of the housing assembly 100 is decreased.

Figure 8:
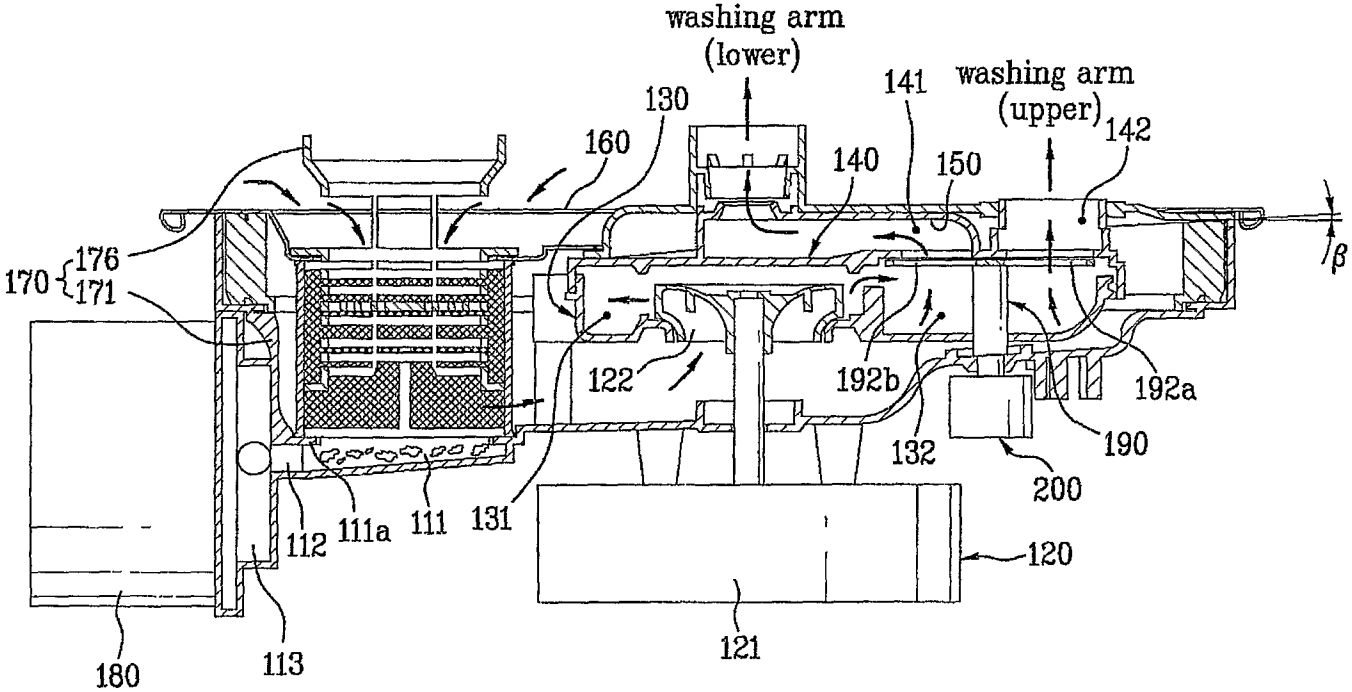
FIG. 8 is a side sectional view illustrating the flow of wash water during a washing operation of the dish washer shown in FIG. 7.

Preferably, the cover 160, which covers the sump 110, is disposed with an inclination (see FIG. 8) toward the filter unit 170 such that the filth and the wash water having fallen to the cover 160 can easily flow to the filter unit 170.

Preferably, a plurality of filter holes 161 are formed in the cover 160 such that some of the wash water having fallen to the cover 160 is filtered and directly introduced into the tub. More preferably, the filter holes 161 are disposed in the cover 160 at regions where the housing assembly 100 is not located such that the contamination of the outer surface of the housing assembly due to the contaminated wash water is minimized.

The filter unit 170 is constructed such that the lower end of the filter unit 170 is open. The open lower end of the filter unit 170 is coupled to the filth receiving chamber 111. Preferably, the lower end of the filter unit 170 is spaced a predetermined distance from the bottom of the filth receiving chamber 111. For example, a step part 111*a* is formed at the upper end of the filth receiving chamber 111 such that the open lower end of the filter unit 170 can be supported by the step part 111*a*. The discharge flow channel 112 is disposed below the step part 111*a* of the filth receiving chamber 111. Consequently, filth in the filth receiving chamber 111 is discharged to the drainage chamber 113 through the discharge flow channel 112 without the interference of the filter unit 170.

The filter unit 170 includes an upper filter 176 fitted through the cover 160 for allowing the filth and the wash water having fallen to the cover 160 to pass therethrough and a lower filter 171 coupled to the upper filter 176 and the filth receiving chamber 111 for filtering out filth from the wash water. The lower filter 171 has an open lower end.

Preferably, the upper filter 176 and/or the lower filter 171 are detachably attached to the cover 160. The upper filter 176 serves to filter out large particles of food wastes, and the lower filter 171 serves to filter out small particles of food wastes that have not been filtered out by the upper filter 176.

Preferably, the upper filter 176 protruded a predetermined height from the top of the cover 160. This is because a user can easily pull out the upper filter 176 while holding the upper filter 176. Of course, it is not necessarily needed for the upper filter to protrude from the top of the cover so long as the user can easily pull out the upper filter 176 while holding the upper filter 176.

The flow channel control valve 190 includes a rotary shaft 191 coupled to a shaft of a control motor 200 and a flow channel opening and closing plate 192 disposed at the upper end of the rotary shaft 191, formed generally in the shape of a disc, and having communication holes 192*a* and 192*b* for selectively or simultaneously opening and closing the main flow channels 141 and 142 when the flow channel opening and closing plate 192 is rotated. The flow channel control valve 190 is formed in the shape of a disc because the main flow channels 141 and 142 are disposed above the flow channel control valve 190. Also, the flow channel control valve 190 is constructed in a structure in which pumping pressure of the washing pump 120 is applied upward. Consequently, when the pumping pressure is applied, the flow channel control valve 190 is pressed against the upper housing 140, and therefore, the flow channel control valve 190 is stably supported without shaking.

The communication holes 192*a* and 192*b* formed in the flow channel opening and closing plate 192 have different areas. Consequently, it is possible to selectively control the main flow channels 141 and 142 depending upon the rotating positions of the flow channel opening and closing plate 192.

Now, the operation of the dish washer with the above-stated construction according to the present invention will be described. The dish washer performs sequentially or selectively a preliminary washing operation, a main washing operation, a rinsing operation, a heating-rinsing operation, and a drying operation so as to wash dishes. Between the respective operations, a draining operation is performed. Hereinafter, the main washing operation and the draining operation will be described.

First, the washing operation of the dish washer will be described in detail with reference to FIGS. 8, 11, and 12 to 14.

When the washing motor 121 is driven, the impeller 122 is rotated. As a result, wash water is supplied from the sump 110 to the pump compartment 131 and the flow channel control compartment 132.

At this time, the flow channel control valve 190 is rotated such that the main flow channels 141 and 142 communicate with the flow channel control compartment 132. Here, the flow channel control valve 190 may selectively open one of the main flow channels 141 and 142 or simultaneously open both the main flow channels 141 and 142. Otherwise, the flow channel control valve 190 may alternately open the main flow channels 141 and 142.

When the main flow channels 141 and 142 are opened, the wash water is supplied from the flow channel control compartment 132 to the corresponding washing arms along the main flow channels 141 and 142 such that the wash water can be injected by the washing arms.

Figure 12:
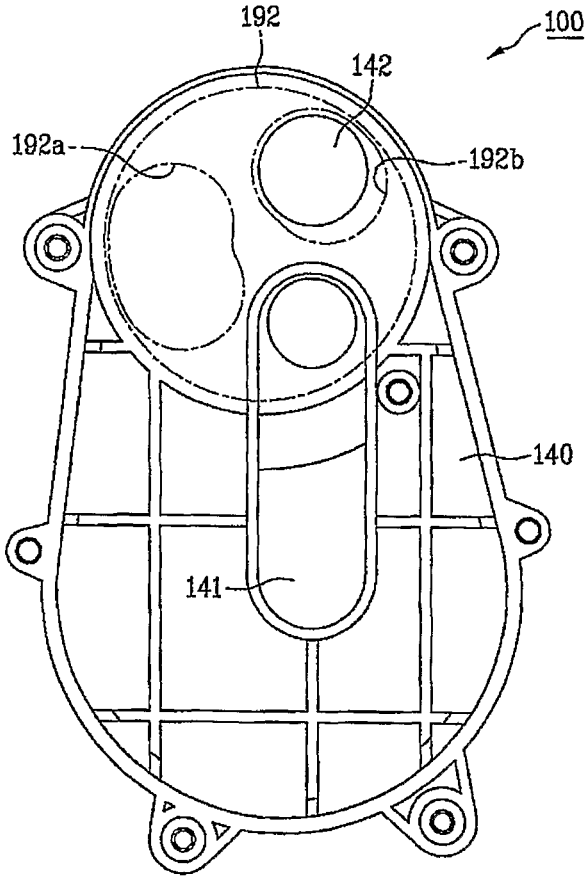
FIGS. 12 to 14 are plan views illustrating main flow channels controlled according to rotating positions of a flow channel control valve with a connection housing being removed.
Figure 13:
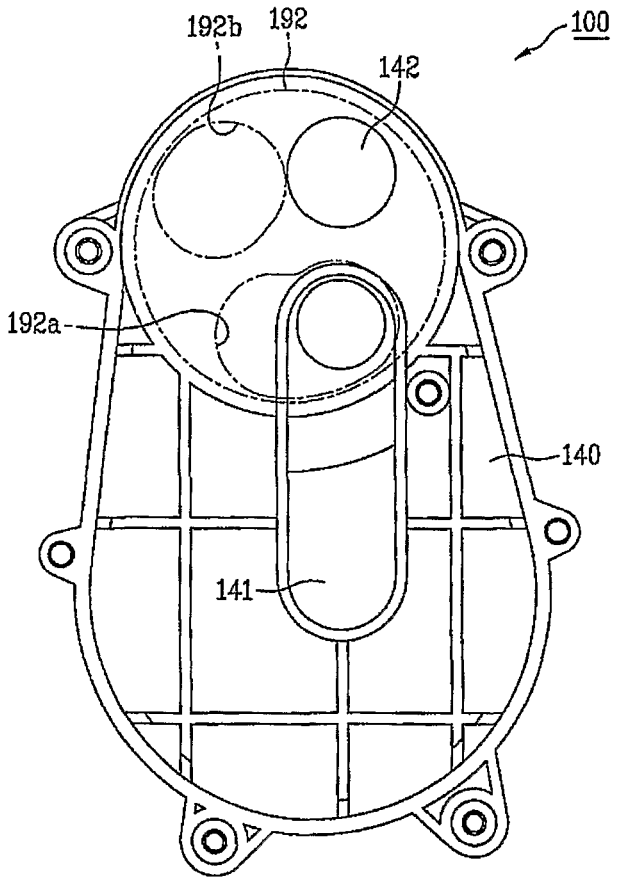
Figure 14:
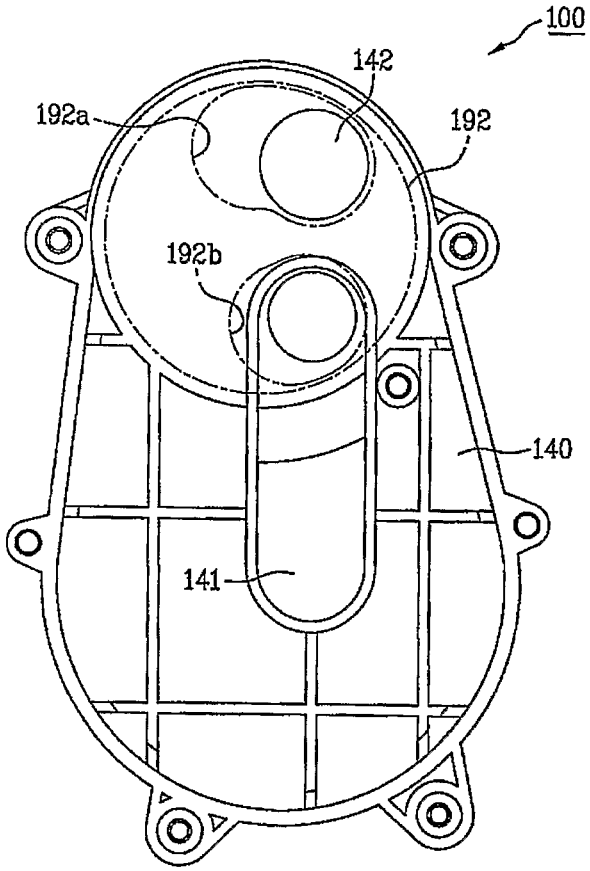
Figure 15:
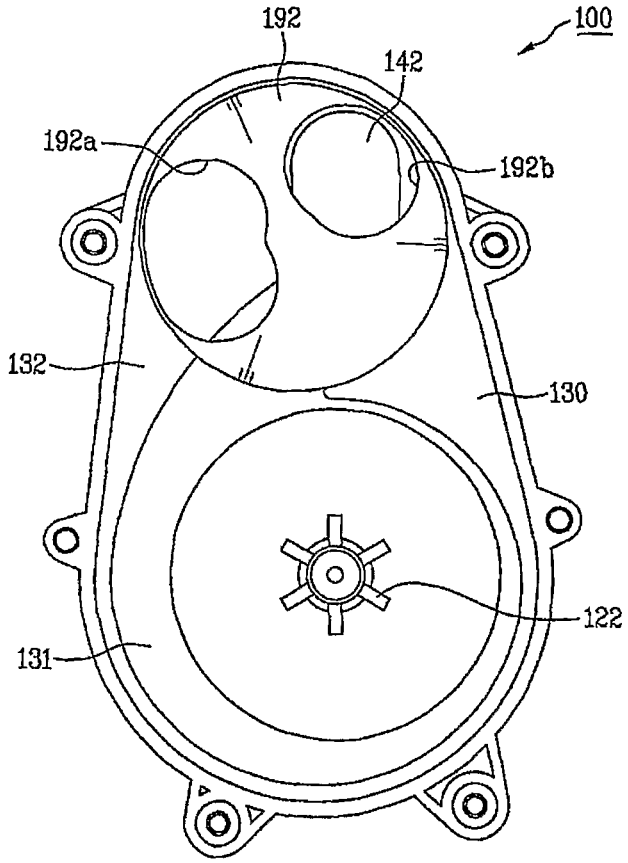
FIG. 15 is a reference view of FIG. 12, illustrating a plan view of the housing assembly with an upper housing being removed.

When the flow channel opening and closing plate 192 of the flow channel control valve 190 is positioned as shown in FIG. 12, for example, the wash water is supplied to the upper washing arm 4 (see FIG. 1) through the main flow channel 142. When the flow channel opening and closing plate 192 of the flow channel control valve 190 is positioned as shown in FIG. 13, the wash water is supplied to the lower washing arm 5 (see FIG. 1) through the main flow channel 141. When the flow channel opening and closing plate 192 of the flow channel control valve 190 is positioned as shown in FIG. 14, the wash water is supplied to the upper and lower washing arms 4 and 5 through both the main flow channels 141 and 142.

The dish washer according to the present invention is not provided with a sampling flow channel unlike the conventional dish washer. For this reason, all the pumped wash water is supplied to the washing arms. As a result, the amount of wash water injected to dishes is increased, and all the pumped wash water is substantially used to wash the dishes. Consequently, it is possible to apply a washing pump 120 having a capacity smaller than that of the washing pump used in the conventional dish washer to the dish washer according to the present invention. Also, the consumption of wash water is considerably reduced. Furthermore, the wash water flow channel of the dish washer according to the present invention is simplified as compared to the conventional dish washer. Consequently, the flow channel resistance of the wash water is decreased, and therefore, the pumping efficiency is improved although the capacity of the washing pump 120 of the dish washer according to the present invention is equal to that of the washing pump of the conventional dish washer.

The wash water injected from the washing arms washes dishes and falls to the cover 160. At this time, the filth and the wash water having fallen to the cover 160 are introduced into the upper filter 176 because the cover 160 is inclined toward the filter unit 170. Also, some of the wash water is directly introduced into the sump 110 through the filter holes 161 of the cover 160.

The upper filter 176 filters out large particles of filth, and the lower filter 171 filters out filth that has not been filtered out by the upper filter 176. Consequently, only wash water containing no filth is introduced into the sump 110.

According to the present invention, it is not needed to periodically clean the filter unit 170 during the washing operation of the dish washer unlike the conventional dish washer. Consequently, it is possible to provide the same injection amount of wash water as the conventional dish washer although a smaller amount of wash water is pumped than the conventional dish washer. In addition, the consumption of the wash water is considerably reduced.

The washing operation is performed for a predetermined period of time. As time passes, the amount of food wastes gathered in the filter unit 170 is gradually increased. After the washing operation is completed, a draining operation of the dishwasher is initiated.

Figure 9:
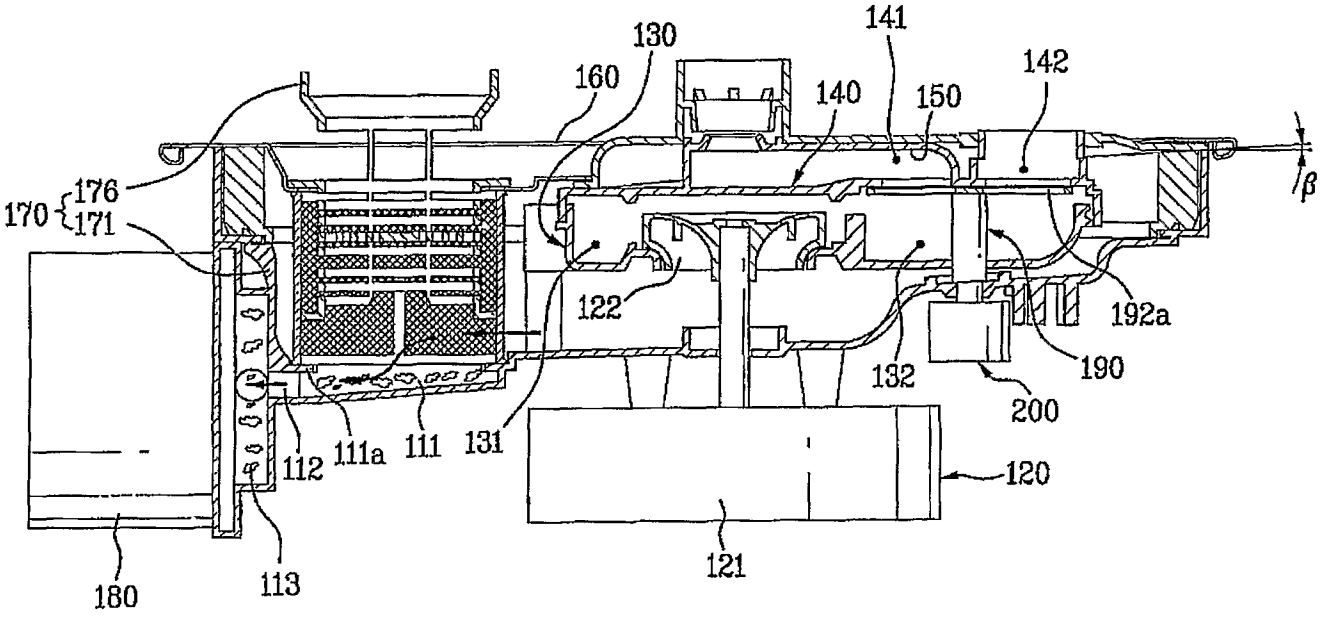
FIG. 9 is a side sectional view illustrating the flow of wash water during a draining operation of the dish washer shown in FIG. 7.
Figure 10:
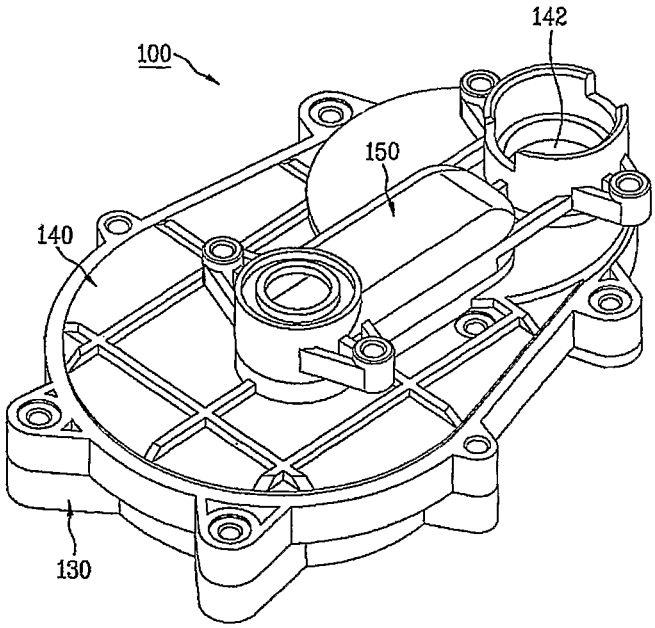
FIG. 10 is a detailed perspective view illustrating a housing assembly shown in FIG. 7.
Figure 11:
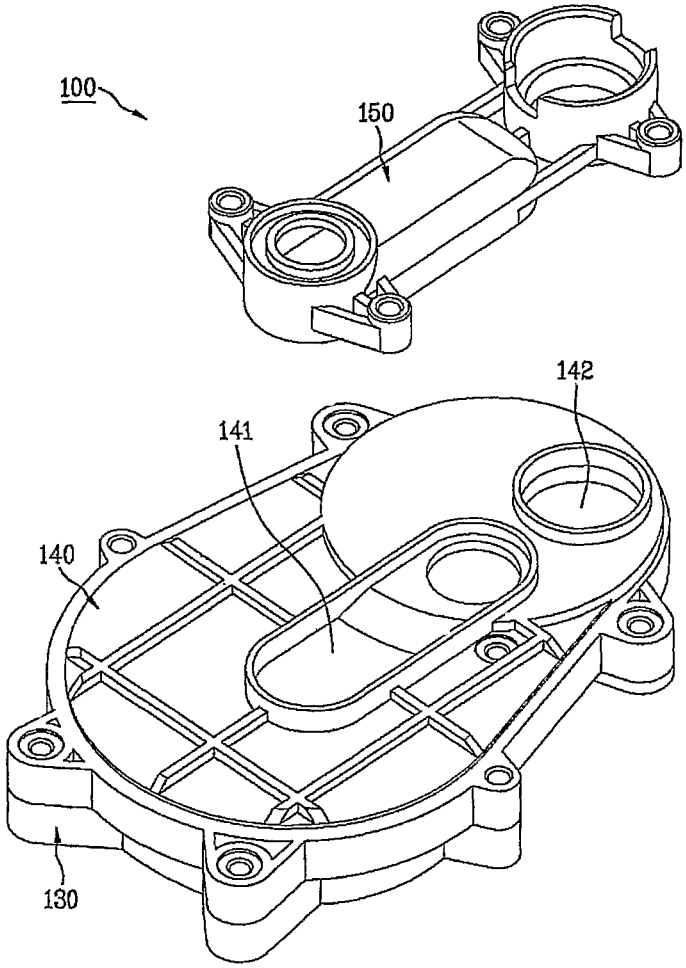
FIG. 11 is an exploded view of FIG. 10.

Hereinafter, the draining operation of the dish washer will be described with reference to FIG. 9.

When the drainage pump 180 is driven, the wash water in the sump 110 is introduced into the filth receiving chamber 111 through the lower filter 171 due to the suction force of the drainage pump 180. Then, the wash water is introduced into the drainage chamber 113 together with the filth gathered in the filth receiving chamber 111. At this time, the filth is smoothly introduced into the drainage chamber 113 because the filth receiving chamber 111 is inclined toward the drainage chamber 113. Subsequently, the filth and the wash water in the drainage chamber 113 are discharged to the outside through the drainage hose of the drainage chamber 113.

According to the present invention, the drainage section (the flow channel between the filth receiving chamber 111 and the drainage chamber 113) is considerably short as compared to the conventional dish washer. Consequently, hardly any of the filth is left in the drainage section.

Due to the aforesaid action, the filth gathered in the filth receiving chamber 111 is completely discharged to the outside during the draining operation of the dish washer.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention provides a dish washer. More particularly, the present invention provides a dish washer having improved washing efficiency while being constructed in a compact structure. A general dish washer is an apparatus that injects wash water to dishes so as to wash the dishes, and dries and/or sterilizes the washed dishes. The dish washer according to the present invention includes a filter unit for filtering at least some of the wash water injected from a tub, fallen downward, and directed to a collection part of a sump.

According to the present invention, it is possible to improve the washing efficiency of the dish washer, reduce the capacity of the washing pump, considerably decrease the amount of wash water substantially needed during a washing operation of the dish washer, reduce the consumption of wash water and power, reduce the flow channel resistance, considerably increase the wash water pumping pressure, simplify the structure of the drive unit, considerably reduce the height of the drive unit, increasing the inner space of the sump, and minimally prevent food wastes from being left in the sump during a drainage operation of the dish washer.

The invention claimed is:

1. A dish washer comprising:

a tub to receive dishes;

an upper arm and a lower arm provided in the tub to spray water;

a sump having a collection part that provides a space that collects and stores wash water;

a housing assembly provided inside the collection part, wherein the housing assembly comprises:

a connection housing having a first hole to communicate with the upper arm and a second hole to communicate with the lower arm;

an upper housing coupled to a lower side of the connection housing and including a first main flow channel connecting the first hole with a first inlet and a second main flow channel connecting the second hole with a second inlet, wherein the first inlet and the second inlet are provided in the same plane;

a lower housing coupled to a lower side of the upper housing and having a pump compartment communicating with the collection part and a flow channel control compartment located under the first inlet and the second inlet to surround the first inlet and the second inlet;

an impeller provided in the pump compartment to pump the wash water in the collection part to the flow channel control compartment; and a flow channel control valve comprising:

a flow channel opening/closing plate formed in a shape of disc and rotatably provided in the flow channel control compartment;

a first communication hole and a second communication hole provided in the same plane of the flow channel opening/closing plate to selectively or simultaneously open the first inlet and the second inlet when the flow channel opening/closing plate is rotated.

2. The dish washer according to claim 1, further comprising:

a filter unit disposed at one side of the collection part for filtering at least some of wash water directed from the tub to the collection part of the sump; and a filth receiving chamber to receive filth filtered out by the filter unit, wherein the filth receiving chamber is disposed at a bottom of the sump and the filter unit is opened at a lower end thereof such that the filtered-out filth is directed to the filth receiving chamber.

3. The dish washer according to claim 2, wherein the filth receiving chamber has a bottom lower than a bottom of the collecting part and the bottom of the filth receiving chamber is inclined downward toward the opposite side of the collecting part.

4. The dish washer according to claim 2, wherein a bottom of the filth receiving chamber is inclined downward toward the discharge flow channel.

5. The dish washer according to claim 2, wherein the filter unit is easily attachable and detachable.

6. The dish washer according to claim 2, wherein the filter unit comprises:

a lower filter having an open lower end and located in the filth receiving chamber; and an upper filter that filters out large particles of filth from wash water before the wash water is filtered by the lower filter.

7. The dish washer according to claim 6, wherein the upper filter is located in the lower filter such that the upper filter can be attached to and detached from the lower filter.

8. The dish washer according to claim 7, wherein the upper filter can be attached to and detached from the lower filter through a cover that covers the sump.

9. The dish washer according to claim 8, wherein the lower filter is blocked by the cover so that the lower filter is prevented from being detached through the cover.

10. The dish washer according to claim 2, further comprising: a cover that covers the sump, the cover having a plurality of filter holes, through which some of the wash water from the tub is directed to the collection part without passing though the filter unit.

11. The dish washer according to claim 10, wherein the cover has a through-hole to communicate with the filth receiving chamber and the filter unit is inserted into the filth receiving chamber through the through-hole.

12. The dish washer according to claim 11, wherein the cover is inclined downward toward the through-hole.

13. The dish washer according to claim 1, wherein the flow channel control valve further comprises a rotary shaft coupled to a shaft of a motor, and wherein the flow channel opening/closing plate is connected to an upper end of the rotary shaft.

14. The dish washer according to claim 1, further comprises a washing motor fitted through a bottom of the sump and axially coupled to the impeller in the vertical direction, wherein the washing motor is an outer-rotor type brushless direct current (BLDC) motor.

15. The dish washer according to claim 14, wherein the washing motor is fitted through a bottom of the collection part.

16. The dish washer according to claim 2, further comprises a drainage pump and a motor that drives the drainage pump, wherein the drainage pump is disposed at one side of the filth receiving chamber.

17. The dish washer according to claim 16, wherein the filth receiving chamber having a discharge flow channel disposed on a side wall of the filth receiving chamber and the discharge flow channel extends to the drainage pump.

18. The dish washer according to claim 2, wherein the filter unit is the main filter for the dish washer.

19. The dish washer according to claim 2, wherein the filth receiving chamber is formed as part of a lower part of the sump.

* * * * *